United States Patent [19]

Pezzillo et al.

[11] 4,388,614

[45] Jun. 14, 1983

[54] AUTOMATICALLY SEQUENCED SIGNALING SYSTEM

[75] Inventors: William A. Pezzillo, Mt. Pleasant, Pa.; Charles C. Crickmer, Huntington, W. Va.

[73] Assignee: The United States of America as represented by the Secretary of the Air Force, Washington, D.C.

[21] Appl. No.: 216,103

[22] Filed: Dec. 15, 1980

[51] Int. Cl.[3] ..... G08B 3/00

[52] U.S. Cl. ..... 340/384 E; 331/108 D; 340/384 R

[58] Field of Search ..... 340/384 E, 384 R; 331/108 C, 108 D

[56] References Cited

U.S. PATENT DOCUMENTS

| | | | |
|---|---|---|---|
| Re. 28,745 | 3/1976 | Smith | 340/384 E |
| 4,086,589 | 4/1978 | Cieslak et al. | 340/384 E |
| 4,189,718 | 2/1980 | Carson et al. | 340/384 E |
| 4,206,448 | 6/1980 | Davis | 340/384 E |
| 4,232,305 | 11/1980 | Lelaidier et al. | 340/384 E |

*Primary Examiner*—Marshall M. Curtis
*Assistant Examiner*—Daniel Myer
*Attorney, Agent, or Firm*—Donald J. Singer; William Stepanishen

[57] ABSTRACT

An automatically sequenced signal utilizing cross-coupled monostable multivibrators to provide a signaling sequence on time, off time and a total sequencer on time, thereby permitting a coded sequence signal to be transmitted. The timing interval of the multivibrators may be varied over a predetermined range.

5 Claims, 2 Drawing Figures

AUTOMATICALLY SEQUENCED SIGNALING SYSTEM

STATEMENT OF GOVERNMENT INTEREST

The invention described herein may be manufactured and used by or for the Government for governmental purposes without the payment of any royalty thereon.

BACKGROUND OF THE INVENTION

The present invention relates broadly to a signaling system, and in particular to an automatically sequenced signaling system.

The prior art signal generator generates a ringing tone continuously from the beginning of its ringing operation to the end of its ringing cycle. Recently, two-step type tone generators have been used which are adapted to generate, for a predetermined period of time from the time of initial ringing, a low frequency ringing tone, a low level ringing tone or an intermittent ringing tone and thereafter to generate a continuous ringing tone. Heretofore, most of these two-step type ringing tone generators have been operated through the provision of mechanical means. Consequently, they have the disadvantages of being complex in structure, difficult in manufacture, and quite apt to become faulty after very little use.

At the present time, small towns and many civilian and military complexes utilize a sequentially coded signal, in the form of a siren or bell or the like, to signal a predesignated area or district in which the problem exists. Such type of system is generally utilized for fire distress situation.

When fire alarm is requested, someone must manually hold a switch down for the prescribed fire alarm signal. This system requires that the operator time the desired signal. If the operator is busy with the alarm system, he is not available to answer the phone and give directions, or to notify the Commander, etc. The present system has caused problems because of interpretation of required signal. The present invention provides an automatically sequenced signaling system that sounds an automatic signal for a precise time interval.

SUMMARY OF THE INVENTION

The present invention utilizes monostable multivibrators in a cross-coupled arrangement to establish a sequence range of a predetermined time interval. A timing circuit is used in conjunction with the various multivibrator pairs to provide a plurality of signal sequencing combinations. The signal sequencing is accomplished by using two cross-coupled 74121 monostable multivibrators which give a sequence range of 40 ns to 40 sec depending upon the resistance and capacitance used. The first monostable is set for the on time and the second for the off time. Along with the monostable there are two 555 IC timers which control the total sequencer on time. The unit is manually operated by turning it on, selecting the proper sequence, placing the auto-manual switch to auto, and then pressing start.

It is one object of the present invention, therefore, to provide an improved automatically sequenced signaling system.

It is another object of the invention to provide an improved automatically sequenced signaling system wherein one of the plurality of sequenced signals is automatically provided.

It is another object of the invention to provide an improved automatically sequenced signaling system wherein an automatic signal with a precise time interval is achieved.

It is yet another object of the invention to provide an improved automatically sequenced signaling system wherein the alarm signal is automatic in time and frequency, thereby eliminating confusion and inconsistency in signaling.

These and other advantages, objects and features of the invention will become more apparent after considering the following description taken in conjunction with the illustrative embodiment in the accompanying drawings.

DESCRIPTION OF THE PREFERRED EMBODIMENT

Figure 1A:
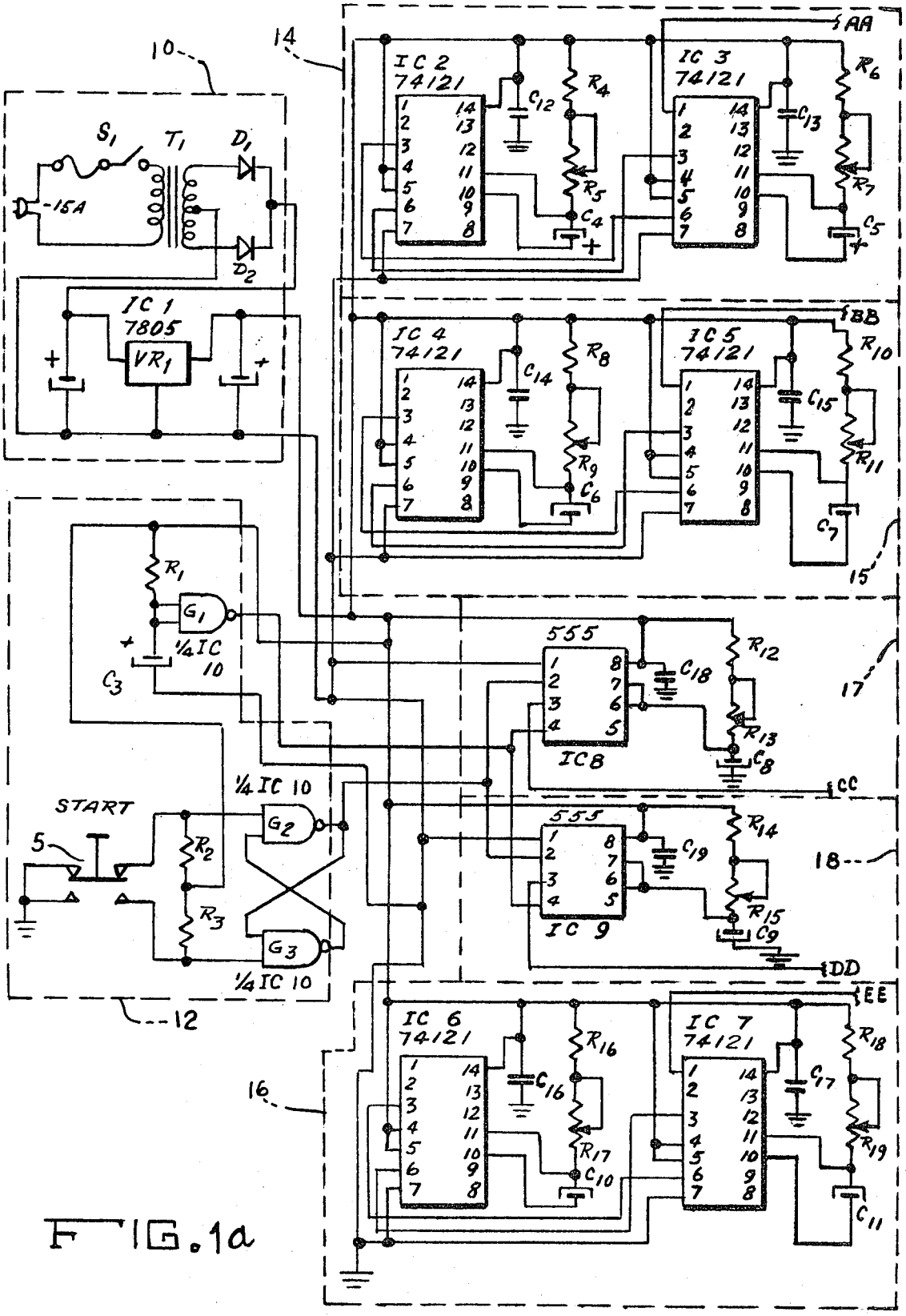
FIGS. 1*a*, 1*b* are a block diagram, shown in partial schematic form of the automtically sequenced signaling system according to the present invention.

Referring now to the FIG. 1*a*, there is shown an automatically sequenced signaling system for achieving the automatic sounding of an alarm which may comprise a particular signaling sequence or coded signal. The signaling system utilizes a power supply circuit 10 to provide the necessary voltages for system operation. A control unit 12 includes a start switch 5 to permit an operator to initiate the automatic signaling sequence. The multivibrator unit 14 comprises a pair of cross-coupled monostable multivibrators, IC2, IC3 to provide a sequence range of 40 nano-seconds to 40 seconds depending upon the system requirements. The multivibrator units 15, 16, respectively, comprise integrated circuits IC4, IC5 and IC6, IC7 to each provide a sequence range of 40 nano-seconds to 40 seconds. The integrated circuits IC2 through IC7 are 74121 integrated circuit units and are utilized to determine the system on-time and the off-time. Two timing units 17, 18 which respectively are comprised of integrated circuit units 555, are utilized to control the system total sequencer on time. It may be noted that points, AA, BB, CC, DD and EE in FIG. 1*a* are connected to points of the same designation in FIG. 1*b* to form a total circuit as shown in FIG. 1*a* and FIG. 1*b*.

Figure 1B:
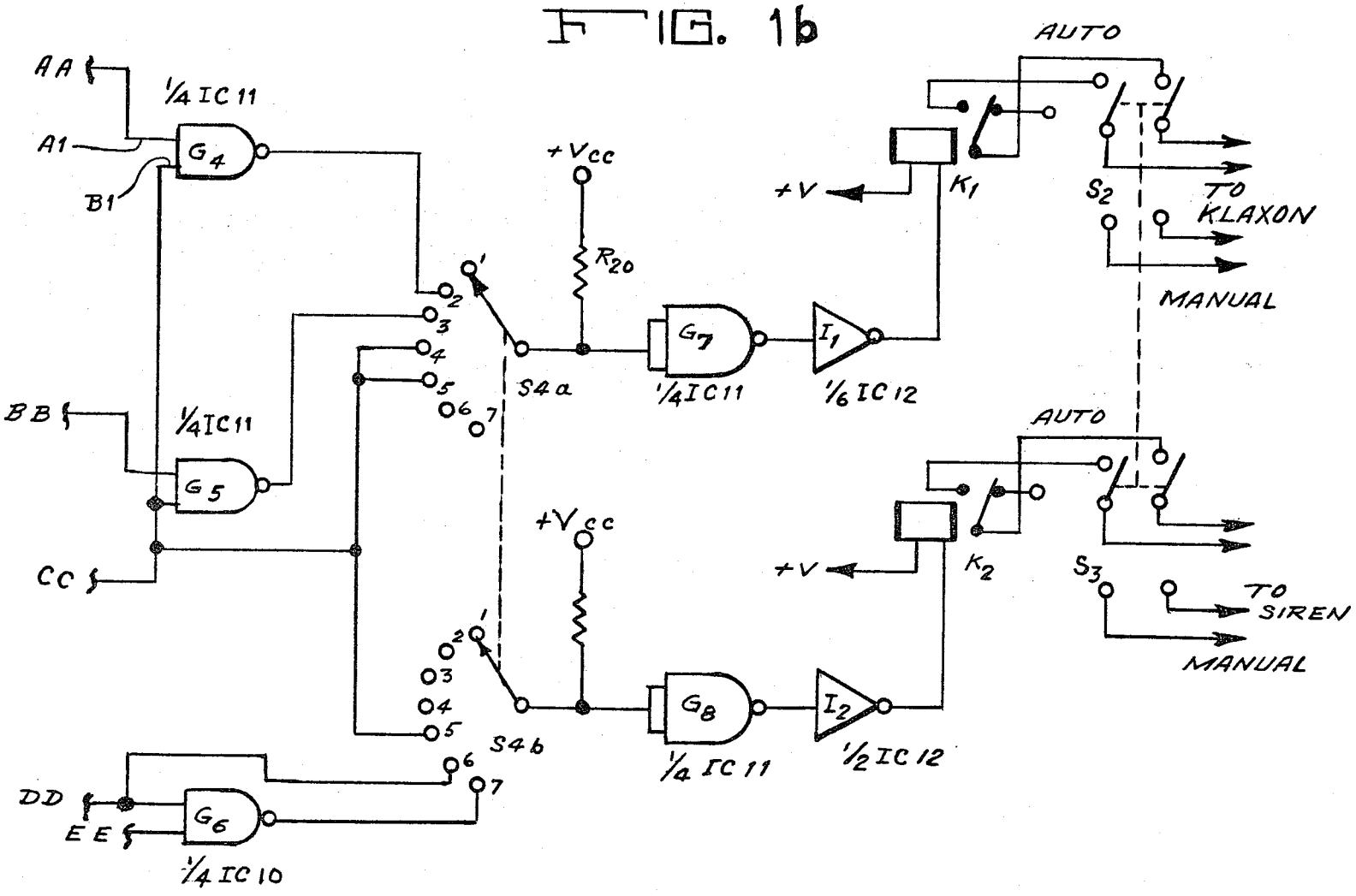

Turning now to FIG. 1*b*, it may be seen that the output of multivibrator unit 14 of FIG. 1*a* is connected by means of point AA to the first input of nand gate G4. The outputs of multivibrator units 15, 16 are respectively connected through points BB, EE to the first input of nand gates, G5, G6, respectively. The timing unit 17 of FIG. 1*a* is connected by means of point CC to the second input of both nand gates G4, G5. The timing unit 18 of FIG. 1*a* is connected by means of point DD to the second input of nand gate G6. Switch S4*a*, S4*b* is a two wafer ganged rotary switch with at least seven positions thereon. Switch position 1 of switch S4*a-b* is the off position. Position 2 of switch S4*a* is connected to the output of nand gate G4. Position 3 of switch S4*a* is connected to the output of nand gate G5. Positions 4 and 5 of switch S4*a* and position 5 of switch S4*b* are connected to each other and to the output of timing unit 17 of FIG. 1*a* through point CC. Position 6 of switch S4*b* is connected by means of point DD to the output of timer unit 18 of FIG. 1*a*. Position 7 of switch S4*b* is connected to the output of nand gate G6. The rotary arms of switch S4*a,b* are respectively connected to the input of gates G7, G8 both of which are respectively connected to +Vcc by resistors $R_{20}$, $R_{21}$. The output of nand gate G7 is connected to buffer unit I1 which one-sixth of integrated circuit IC12, a hex buffer with open collector, high voltage output. Buffer unit I1 is utilized as a relay driver for relay unit K1. When relay unit K1 is activated, the switch contact therein is closed and the klaxon (not shown) is sounded through switch S2 in the auto position when switch S4*a* is in position 2 through 5. Buffer unit I2 is the relay driver for relay unit K2. When relay unit K2 is activated, the switch contact therein is closed and the siren (not shown) is sounded through switch S3 in the auto position, when switch S4*b* is in positions 5 through 7.

The automatically sequenced signaling system operates in the following manner. The signaling sequence and the total interval time is established by a pair of monostable multivibrator integrated circuit (IC) chips, and the 555 IC timers. The 555 IC may be used as a one shot, free running or gated oscillator. It may be operated with a Vcc source of 4.5 to 16 volts. The timing range may be set from microseconds to hours. It has an adjustable duty cycle which is accomplished by external resistive-capacitor (RC) networks, R12, R13, C8 and R14, R15, C9, respectively connected across Vcc and pin 6, threshold (TH) and discharge (DS) pin 7.

The 555 IC's in this sytem are adjusted for the total on time. The integrated circuit, IC 6 controls the total on time for integrated circuits IC's 2, 3, 4, 5. The integrated circuit IC 7 controls the on time for integrated circuit IC 8 and 9. The following equation is used to determine the on time for this system.

D = Duty cycle  $t_1$ = High output  $t_2$ = Low output
R = ohms  C = farads $$D = \frac{Rb}{Ra + 2Rb} \quad t_1 = 0.693\,(Ra + Rb) \times C;$$
$$t_2 + 0.693\,(Rb \times C)$$

$$T = 0.693\,(Ra + 2Rb) \times C$$

In the present example:
Ra = Resistors R12 & R14, Rb = Resistors R13 & R15
C = Capacitors C8 & C9
$T_1 = 0.693\,(1000 + 1 \times 10^6) \times .000470$
= 326 seconds or 5.4 minutes (high)

The system was adjusted for the following signals. Switch S4*a,b* selects the proper signal. Switch S5 is the start button. Switch S4*a,b* is in the switch position number as shown below:

| | | | |
|---|---|---|---|
| 1. Off | | | |
| 2. Fire Housing Area | 3 Min Long | 5 Sec Intervals | Klaxon |
| 3. Fire Operations | 3 Min Long | 10 Sec Intervals | Klaxon |
| 4. Fire Squadrons | 3 Min Long | Steady | Klaxon |
| 5. MARE | 3 Min Long | Steady | Klaxon & Sirens |
| 6. Recall | 5 Min Long | 10 Sec Intervals | Siren |
| 7. Shelter | 5 Min Long | 3 Sec Intervals | Siren |

The integrated circuits are adjusted as follows:

| | |
|---|---|
| IC 6 | 3 Minutes On (High) |
| IC 2 & 3 | 5 Seconds On/Off |
| IC 4 & 5 | 10 Seconds On/Off |
| IC 7 | 5 Minutes On |
| IC 8 & 9 | 3 Seconds On/Off |

The integrated circuits IC 2 and 3 are 74121 monostable multivibrator transistor-transistor-logic (TTL). The 74121 IC's are Schmitt circuitry, cross connected to flip-flop on and off at the desired sequence. The integrated circuits IC's 2 and 3 are examples of the other circuits, IC 4, IC5, IC8, and IC9.

The integrated circuit IC 2 is adjusted for the on time and integrated circuit IC 3 is adjusted for the off time to give an interval signal to nand gate G4. The integrated circuit IC 2 has pins 4 and 5 connected to +5 volts Vcc. This puts pin 5 as a high input to an and gate. Pin 4 is a high input to an OR gate. Pin 3 of integrated circuit IC 2 is cross connected to pin 6 of IC 3 which is a low output. With a high on pins 4 & 5 and a Low on pin 3, the or gate output is high to the and gate. With a high on pin 5 and a high from the or gate gives a high input to the multivibrator S input. The multivibrator which is part of the 74121 integrated circuit has an S and an R input. The S input to the multivibrator is an internal connection that is not accessible to an external IC pin. The R input is connected to IC pin 11 on all 74121 integrated circuits to provide external accessibility. The RC circuitry is connected to the R input through pin 11. The output of the multivibrator in the integrated circuit IC3 is high at pin 1 and low at pin 6, which is cross connected to the other multivibrator in the integrated circuit IC2.

The output of integrated circuit IC 3, pin 1 is high and connected to input one or the A1 side of G4 a 7400 IC nand gate. The input 2 or B1 side of the nand gate is connected to pin 3 of integrated circuit IC8, the 555 timer. The high's on gate G4 enables a low output to gate G7. Gate G7's output is a high to integrated circuit IC 12 a 7406 not gate or hex buffer unit. Buffer unit I1 which is part of integrated circuited IC 12 allows relay K1 to energize and the klaxon to sound.

All components of this system are off-the-shelf items. All digital integrated circuits utilize different components to accomplish the required logic. DTL use diode-transistor logic, TTL use transistor-transistor-logic, RTL use resistor-transistor-logic and CMOS are complementary metal oxide-silicon devices.

There is shown in Table I typical values for the components used in the present example:

TABLE I

| Component | Value or Description |
|---|---|
| Transformer T1 | 16VCT 640ma |
| Diodes D1–D2 | IN4002 |
| Capacitor C1 | 2500 μf 15V Elec |
| Capacitor C2 | 1 μf 6V Tantalum |
| Capacitor C3 | 47 μf 50V Elec |
| Capacitors | |
| C4–C11 | 470 μf 16V Elec |
| C12–C23 | .05 μf disc (Vcc to Gnd on each IC) |
| Resistor R1 | 10K |
| Resistors | |
| R2,R3,R20,R21 | 2.2K |
| R4,R5,R8,R10,R16,R18 | 2K |
| R5,R7,R9,R11,R17,R19 | 50K trimpot |
| R12,R14 | 1K |
| R13,R15 | 1M trimpot |
| Integrated Circuits | |
| IC1 | 7805 |
| IC2–IC5, IC6–IC7 | 74121 |
| IC12 | 7406 |
| IC8–IC9 | 555 |
| IC10–IC11 | 7400 |

Digital integrated circuits are identified by numbers such as 7400 which has four nand gates. Each manufacturer adds letters to the basic numbers plus letters to describe speed and package type. Example, 74S00 is a slow speed device, and a 74H00 is a high speed type. The 74LS00 is a low power Schotky integrated circuit which utilizes diode input in place of transistors. Manufacturers add letters to linear circuit devices also. There are no difference to the logic of any of the devices.

| IC# | IC Unit | Circuit Function |
|---|---|---|
| IC 1 | 7805 | Voltage regulator<br>Provides a steady voltage that is unaffected by changes in supply voltage as long as the supply voltage is above the desired output voltage. |
| IC 2, 3, 4, 8, 9 | 74121 | Monostable Multivibrator |
| IC 6, 7 | 555 | Timer<br>Operates as a one shot or a stable multivibrator |
| IC 10, 11 | 7400 | Quad 2 input nand gate |
| IC 12 | 7410 | Hex Buffers with open collector, high voltage output |

The power supply for this system utilizes a step-down transformer, T1. The primary voltage is 117 volts and the secondary can be 12 to 16 volts center-tapped, at 1 amp. Diodes D1 and D2 rectify the secondary voltage. Capacitors C1 and C2 are used as filters, to smooth the rectified voltage. The integrated circuit IC 1 is a 7805 voltage regulator that provides a steady +5 volts output and is unaffected by changes in supply voltage.

Although the invention has been described with reference to a particular embodiment, it will be understood to those skilled in the art that the invention is capable of a variety of alternative embodiments within the spirit and scope of the appended claims.

What is claimed is:

1. An automatically sequenced signaling system comprising in combination:

a control means to initiate a signaling sequence, said control means providing a start signal:

a plurality of interval signal generators to generate interval signals, each of said plurality of interval signal generators being variable in time, each of said plurality of interval signal generators receiving said start signal, each of said plurality of interval generators generating a different interval signal;

first and second sequence timers to provide first and second sequence time signals;

a first gate means to receive said interval signals and said first sequence time signal, said first gate means providing a first output signal;

a second gate means to receive said interval signals and said second sequence time signal, said second gate means providing a second output signal;

a switching means to receive said first and second sequence time signals and said first and second output signals, said switching means having a plurality of switch positions to respectively receive the applied signals; and an alarm driving means connected to said switching means to receive an alarm signal from one of said plurality of switch positions, said alarm signal activating a signaling device.

2. The system as described in claim 1 wherein each interval signal generator of said plurality of interval signal generators comprise a first and second cross-coupled multivibrator.

3. The system as described in claim 2 wherein said first multivibrator generates an on signal for a predetermined time and said second multivibrator generates an off signal for a predetermined length of time.

4. The system as described in claim 1 wherein each of said plurality of interval signal generators are variable in the range of 4 nano-seconds to 40 seconds.

5. The system as described in claim 1 wherein said first sequence time signal is three minutes long and said first sequence time signal is five minutes long.

* * * * *